US006313817B2

(12) United States Patent
Kuijk

(10) Patent No.: US 6,313,817 B2
(45) **Date of Patent: *Nov. 6, 2001**

(54) DISPLAY DEVICE

(75) Inventor: Karel E. Kuijk, Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/137,282

(22) Filed: Aug. 20, 1998

(30) Foreign Application Priority Data

Aug. 26, 1997 (EP) ..... 97202614

(51) Int. Cl.[7] ..... G06G 3/36
(52) U.S. Cl. ..... 345/87; 345/100
(58) Field of Search ..... 345/160, 87, 99, 345/100, 103

(56) References Cited

U.S. PATENT DOCUMENTS 5,420,604 * 5/1995 Scheffer et al. ..... 345/100
5,485,173 * 1/1996 Scheffer et al. ..... 345/100
5,546,102 * 8/1996 Scheffer et al. ..... 345/100

FOREIGN PATENT DOCUMENTS 54-22856 * 8/1979 (JP) ..... H04N/5/66
08179731-A * 7/1996 (JP) ..... G09G/3/36

OTHER PUBLICATIONS

T.N. Ruckmongathan and N.V. Mahusudana, New Addressing Techniques for Multiplexed Liquid Crystal Displays, Proceedings of the SID, vol. 24/3, 1983.*

OTHER PUBLICATIONS

Jurgen Nehring and Allan R. Kmetz, Ultimate Limits for Matrix Addressing of RMS–Responding Liquid Crystal Displays, IEEE Transactions on Electronic Devices, vol. ED–26, No. 5, May 1979.*
"Scanning Limitations of Liquid Crystal Displays", in IEEE Trans. on El. Dev., vol. ED 21, No. 2, Feb., 1974, pp. 146–155.
"Active Addressing Method for High–Contrast Video–Rate STN Displays" by T.J. Scheffer and B. Clifton, in SID Digest 92, pp. 228–231.
"A New Addressing Technique for Fast Responding STN LCDs" by T.N. Ruckmongathan et al., in Japan Display '92, pp. 65–68.

* cited by examiner

*Primary Examiner*—Richard Hjerpe
*Assistant Examiner*—Alexander Eisen

(57) ABSTRACT

Passive display driven by means of multiple-row addressing, in which the drive voltages are decreased by an optimum choice of the number of orthogonal signals.

8 Claims, 1 Drawing Sheet

DISPLAY DEVICE

BACKGROUND OF THE INVENTION

Figure 1:
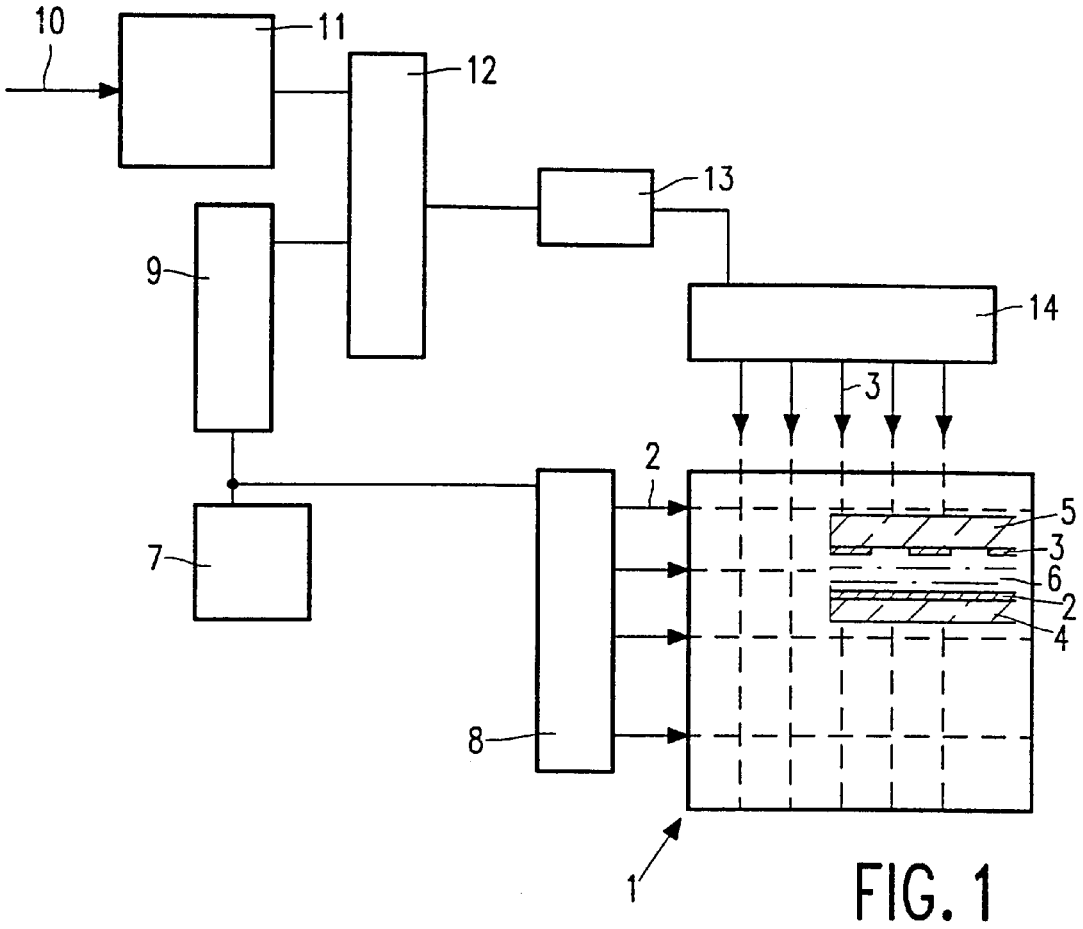

The invention relates to a display device comprising a liquid crystal material between a first substrate provided with row or selection electrodes and a second substrate provided with column or data electrodes, in which overlapping parts of the row and column electrodes define pixels, drive means for driving the column electrodes in conformity with an image to be displayed, and drive means for driving the row electrodes. Such display devices are used in, for example portable apparatuses such as laptop computers, notebook computers and telephones.

Passive matrix displays of this type are generally known and, to be able to realize driving of a large number of rows, they are more and more based on the (S)TN ((Super)-Twisted Nematic)) effect.

In (S)TN liquid crystal display devices, the pixels react to the effective value (rms value) of the supplied voltage. The drive of liquids (pixels) reacting in this manner is described in Alt & Pleshko's article "Scanning Limitations of Liquid Crystal Displays", IEEE Trans. on El. Dev., Vol. ED 21, No.2, February 1974, pp. 146–155.

In these devices, one row is consecutively driven each time. When rapidly switching (S)TN liquid crystal material is used, there is relaxation of the directors within one frame period. This leads to loss of contrast and is sometimes also referred to as "frame response".

Notably in applications in display devices built into portable apparatuses (mobile telephone, laptop computers) the aim is to drive these apparatuses with a minimal energy. It is notably attempted to minimize the drive voltages as much as possible in these cases.

OBJECTS AND SUMMARY OF THE INVENTION

It is an object of the invention to provide a display device of the type described above in which a drive voltage which is chosen to be as favorable as possible is sufficient.

Moreover, the invention aims at a maximal "frame response" reduction.

To this end, a display device according to the invention is characterized in that the multiplexibility m of the liquid crystal material is larger than or equal to the number of row electrodes N, and that the drive means for driving the row electrodes in the operating state sequentially provide groups of p electrodes with p mutually orthogonal signals, the value of p of the number of rows driven simultaneously being an integer which is chosen to be as proximate as possible to the optimum value $p_{opt}=\sqrt{m_{eff}}\pm\sqrt{(m_{eff}-N)}$, in which $N<m_{eff}<m$.

In this application, the multiplexibility of the liquid crystal material m is understood to mean the maximum number of rows which can be driven with a maximum contrast by means of the relevant liquid crystal material, which is determined by the so-called Alt&Pleshko maximum, as described in the above-mentioned article.

The invention is based on the recognition that, when driving p rows simultaneously, the drive voltage of the rows and the maximal drive voltages of the columns can be chosen to be substantially equal to each other. Notably in drive-ICs, which supply row voltages as well as column voltages, this leads to lower power supply voltages.

Preferably, $p_{opt}=\sqrt{m}-\sqrt{(m-N)}$. This yields equal row voltages and (maximally possible) column voltages and leads to the lowest supply voltage for a drive IC where the supply voltage is determined by the highest of the two voltages.

A power of two is preferably chosen for p, which is as proximate as possible to $p_{opt}$ because a set of orthogonal signals consists of a number of functions which is a power of two, and each function of this set further consists of a number of elementary pulses which is the same power of two. If fewer functions for driving are chosen than are present in the set of orthogonal functions, the elementary period of time of the pulses decreases proportionally, which is unfavorable for RC time effects across the columns and rows. Since $P_{opt}$ is not always a power of two, the voltages for the orthogonal signals are not always equal to each other. The mutual deviation remains limited to about 38%.

It is to be noted that an article by T. J. Scheffer and B. Clifton "Active Addressing Method for High-Contrast Video-Rate STN Displays", SID Digest 92, pp. 228–231, describes how "frame response" is avoided by making use of "Active Addressing", in which all rows are driven during the entire field period with mutually orthogonal signals, for example Walsh functions. The result is that each pixel is continuously excited by pulses (in an STN LCD of 240 rows, 256 times per field period) instead of once per field period.

In an article by T. N. Ruckmongathan et al. "A New Addressing Technique for Fast Responding STN LCDs", Japan Display 92, pp. 65–68, a group of L rows is driven with mutually orthogonal signals. Since a set of orthogonal signals, such as Walsh functions, consists of a number of functions which is a power of 2, hence $2^s$, L is preferably chosen to be as equal as possible thereto, hence generally $L=2^s$, or $L=2^s-1$. The orthogonal row signals $F_i(t)$ are preferably square-shaped and consist of the voltages +F and −F, while the row voltage is equal to zero outside the selection period. The elementary voltage pulses of which the orthogonal signals are composed, are regularly distributed in the field period. Thus, the pixels are then excited $2^s$ or $(2^s-1)$ times per field period with regular intervals instead of once per field period. Even for low values of L, such as L=3 or L=7, it appears that the "frame response" is suppressed just as well as the driving of all rows simultaneously, as in "Active Addressing", but much less electronic hardware is required for this purpose. However, neither of the two articles states how drive voltages can be optimized.

BRIEF DESCRIPTION OF THE DRAWINGS/ EMBODIMENTS

These and other aspects of the invention are apparent from and will be elucidated with reference to the embodiments described hereinafter.

Figure 2:
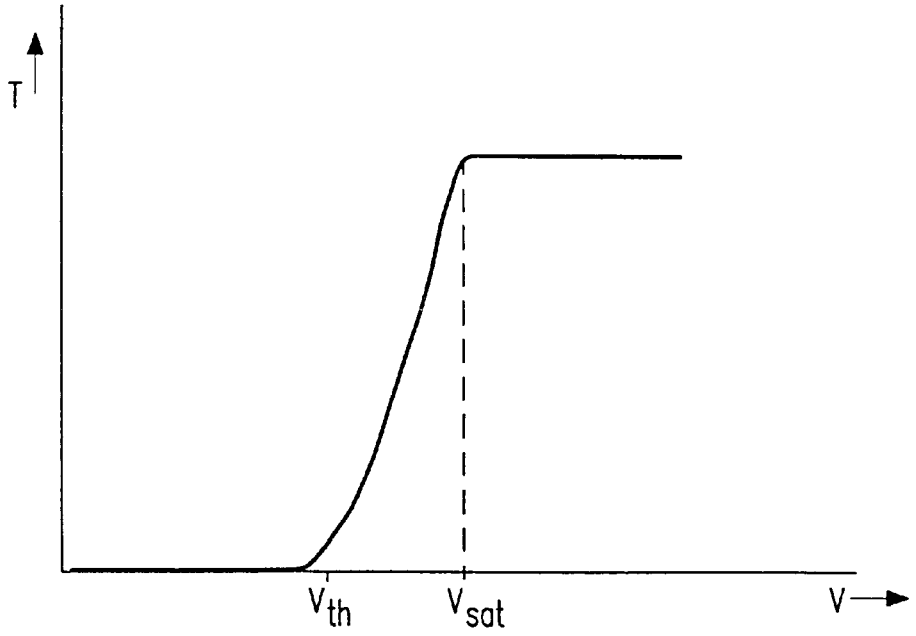

In the drawings:

FIG. 1 shows diagrammatically a display device in which the invention is used, and FIG. 2 shows a transmission/voltage characteristic curve of a liquid crystal material to be used in the device of FIG. 1.

DESCRIPTION OF THE PREFERRED EMBODIMENTS

FIG. 1 shows a display device with a matrix 1 of pixels at the area of crossings of N rows 2 and M columns 3 which are provided as row electrodes and column electrodes on facing surfaces of substrates 4, 5, as can be seen in the cross-section shown in the matrix 1. The liquid crystal material 6 is present between the substrates. For the sake of simplicity, other elements, such as orientation layers, polarizers, etc. are omitted in the cross-section.

The device further comprises a row function generator 7 implemented, for example as a ROM, for generating orthogonal signals $F_i(t)$ for driving the rows 2. Similarly as described in said article by Scheffer and Clifton, row vectors are defined during each elementary time interval, which row vectors drive a group of p rows via drive circuits 8. The row vectors are written into a row function register 9.

Information 10 to be displayed is stored in an N×M buffer memory 11 and read as information vectors per elementary unit of time. Signals for the column electrodes 3 are obtained by multiplying the then valid values of the row vector and the information vector by each other during each elementary unit of time and by subsequently adding the p obtained products. The values of the row and column vectors valid during an elementary unit of time are multiplied by comparing them in an array 12 of M exclusive-ORs. The products are added by applying the output signals of the array of exclusive-ORs to the summing logic 13. The signals 16 from the summing logic 13 drive a column drive circuit 14 which provides the columns 3 with voltages $G_j(t)$ with p+1 possible voltage levels. In this case, p rows are always driven simultaneously, in which p<N. The row vectors therefore comprise only p elements, similarly as the information vectors, which leads to an economy of the required hardware such as the number of exclusive-ORs and the size of the summing circuit, as compared with the method in which all rows are driven simultaneously with mutually orthogonal signals ("Active Addressing").

Generally, it holds for a liquid crystal display device with N rows, whose liquid crystal reacts to the effective value of the voltage, while one row is simultaneously driven with a row selection voltage $V_s$, and the non-selected rows have a voltage equal to zero, and the columns are driven with voltages $+V_d$, that the effective pixel voltage $V_{Poff}$ is:

$$V_{Poff}^2 = \frac{(V_s \pm V_d)^2 + (N-1)V_d^2}{N} \tag{1}$$

or:

$$V_{Poff}^2 = \frac{V_s^2 + NV_d^2 \pm 2V_sV_d}{N} \tag{2}$$

For pixels which are on or off, it then holds:

$$V_{Pon}^2 = \frac{V_s^2 + NV_d^2 + 2V_sV_d}{N}, \tag{3}$$

$$V_{Poff}^2 = \frac{V_s^2 + NV_d^2 - 2V_sV_d}{N}, \quad \text{so that} \tag{4}$$

$$\left(\frac{V_{Pon}}{V_{Poff}}\right)^2 = \frac{V_s^2 + NV_d^2 + 2V_sV_d}{V_s^2 + NV_d^2 - 2V_sV_d}. \tag{5}$$

The voltages are normalized by rendering $V_{Peff}=1$ so that $V_{Poff}^2$ 1. Filling this in in equation (4) leads to:

$$V_s^2+NV_d^2-2V_sV_d=N. \tag{6}$$

Equation (5) can then be rewritten as:

$$\left(\frac{V_{Pon}}{V_{Poff}}\right)^2 = \frac{V_s^2 + NV_d^2 - 2V_sV_d + 4V_sV_d}{V_s^2 + NV_d^2 - 2V_sV_d} = \frac{N + 4V_sV_d}{N}. \tag{7}$$

In a display device according to the invention, N<m, in which m is the number of rows to be maximally multiplexed with a maximum contrast determined by the threshold voltage $V_{th}$ and the saturation voltage $V_{sat}$ of the liquid crystal material (FIG. 2). In accordance with the Alt&Pleshko analysis (IEEE Trans. El. Dev., Vol ED-21, No. 2, Febuary 1974, pp. 146–155), this maximum number of rows is equal to:

$$m = \left\{\frac{\left(\frac{V_{sat}}{V_{th}}\right)^2 + 1}{\left(\frac{V_{sat}}{V_{th}}\right)^2 - 1}\right\}^2. \tag{8}$$

This can also be written as:

$$\left(\frac{V_{sat}}{V_{th}}\right)^2 = \frac{\sqrt{m}+1}{\sqrt{m}-1}. \tag{9}$$

By choosing $V_{sat}$ in equation (7) for $V_{Pon}$ and $V_{th}$ for $V_{Poff}$ instead of maximizing the ratio $V_{Pon}/V_{Poff}$ in accordance with Alt&Pleshko's formula, we find:

$$\left(\frac{V_{Pon}}{V_{Poff}}\right)^2 = \frac{N + 4V_sV_d}{N} = \frac{\sqrt{m}+1}{\sqrt{m}-1}, \text{ or} \tag{10}$$

$$2V_sV_d = \frac{N}{\sqrt{m}-1}, \text{ and} \tag{11}$$

$$V_d = \frac{N}{2V_s(\sqrt{m}-1)}. \tag{12}$$

Substitution of equation (12) in (6) yields:

$$V_s^2 + \frac{N^3}{4V_s^2(\sqrt{m}-1)^2} - \frac{N}{\sqrt{m}-1} = N. \tag{13}$$

This leads to the following equation:

$$V_s^4 - N\left(1 + \frac{1}{\sqrt{m}-1}\right)V_s^2 + \frac{N^3}{2(\sqrt{m}-1)^2} = 0, \tag{14}$$

with the roots $$V_{s1,2}^2 = \frac{N}{2}\left[1 + \frac{1}{\sqrt{m}-1} \pm \sqrt{\left(1 + \frac{1}{\sqrt{m}-1}\right)^2 - N\frac{1}{(\sqrt{m}-1)^2}}\right]. \tag{15}$$

The value of $V_d$ can subsequently be found by filing in the computed value of $V_s$ in equation (12).

If N=m, there is only one solution for $V_s$, namely the value which is found for the Alt&Pleshko maximum.

Generally it holds that, for a selection of p rows simultaneously with mutually orthogonal signals $F_i(t)$, the amplitude of the row voltages F is a factor of $\sqrt{p}$ smaller than the value $V_s$ which, as computed hereinbefore, is the amplitude for the case of driving one row at a time.

$$F = \frac{V_s}{\sqrt{p}}. \tag{16}$$

For the maximal column voltage, the following value is found:

$$G_{max}=V_d\sqrt{p}. \tag{17}$$

If p is chosen to be such that the amplitude of row signals F and the maximal column signal $G_{max}$ are equal, then the required power supply voltage for the drive IC, which is determined by the largest of the two, becomes as small as possible. Equal values for $F_{opt}$ and $G_{max,opt}$ are found when:

$$F_{opt} = \frac{V_s}{\sqrt{p}} = V_d\sqrt{p} = G_{\max,opt}, \quad \text{so that} \tag{18}$$

$$p_{opt} = \frac{V_s}{V_d}. \tag{19}$$

This can be written in a different form as:

$$p_{opt} = \frac{V_s^2}{V_s V_d}. \tag{20}$$

With the equations (11) and (15), this yields:

$$p_{opt} = \left(\sqrt{m} - 1\right) \left[1 + \frac{1}{\sqrt{m} - 1} \pm \sqrt{\left(1 + \frac{1}{\sqrt{m} - 1}\right)^2 - N\frac{1}{\left(\sqrt{m} - 1\right)^2}}\right], \tag{21}$$

or $$p_{opt} = \sqrt{m} \pm \sqrt{m - N}. \tag{22}$$

By choosing the minus sign in equation (22), the smallest value of $p_{opt}$ is obtained. This is favorable because then the number of possible levels p+1 of the column signals is as small as possible, which reduces the hardware of the column portion of the drive IC. Substitution of equation (20) in (11) yields:

$$2\frac{V_s^2}{p_{opt}} = \frac{N}{\sqrt{m} - 1}, \quad \text{so that} \tag{23}$$

$$\frac{V_s}{\sqrt{p_{opt}}} = \sqrt{\frac{N}{2\left(\sqrt{m} - 1\right)}}. \tag{24}$$

Filling this in in equation (18) yields $$F_{opt} = G_{\max,opt} = \sqrt{\frac{N}{2\left(\sqrt{m} - 1\right)}}. \tag{25}$$

If $p_{opt}$ is not a power of 2, the nearest power of 2 can be chosen for p. In that case, the amplitude of the row signal F and the maximal column voltage $G_{max}$ are unequal and equal, respectively, to:

$$F = \frac{V_s}{\sqrt{p}}, \tag{26}$$

$$G_{max} = V_d\sqrt{p}. \tag{27}$$

By making use, according to the invention, of a liquid crystal material with a multiplexibility m, as given by Alt&Pleshko's maximum, which is higher than the real number of rows N to be driven, and for addressing a plurality of rows simultaneously with mutually orthogonal signals, "Multiple-Row Addressing", it is sufficient to use an optimum row voltage which is maximally a factor $$\frac{V_s}{F_{opt}} = \sqrt{\frac{\sqrt{N}\left(\sqrt{m} - 1\right)}{\sqrt{N} - 1}} \tag{28}$$

lower than when driving one row at a time in accordance with Alt&Pleshko's method and formulas for N rows.

EXAMPLE 1

For a display with N=64 rows, in which a liquid crystal is used which is 64 times multiplexible (m=64), in which case Alt&Pleshko's maximum is found, this yields:

$V_s = 6.047 \times V_{th}$, $V_d = 0.756 \times V_{th}$, $p_{opt} = 8$, $F_{opt} = G_{max,opt} = 2.138 \times V_{th}$. With V th=1.4

V, the amplitude of the row voltage would be Vs=8.466 V when driving one row at a time, and that of the column voltage $V_d$ would be 1.058 V. If 8 rows are driven every time with mutually orthogonal signals, the amplitude of the row voltage F will become 2.993 V and that of the maximum column voltage $G_{max}$ will also become 2.993 V. A drive IC is then sufficient with a power supply voltage $V_B = 2 \times 2.993 = 5.987$ V instead of $V_B{}^1 = V_s + V_d = 9.525$ V, which is the case when driving with one row at a time! For the ratio $F/G_{max}$ between the row voltages and the maximal column voltages, it holds in this example (where $m = m_{eff}$): $F/G_{max} = 1$.

EXAMPLE 2

The same display with N=64 rows now has a liquid crystal with m=121. Then the formulas based on the invention yield:

$V_s = 3.323 \times V_{th}$, $V_d = 0.963 \times V_{th}$, $p_{opt} = 3.45$, $F_{opt} = G_{max,opt} = 1.789 \times V_{th}$.

Since p must be an integer, preferably a power of 2 ($p = 2^s$), p is chosen to be 4 so that $F = 1.661 \times V_{th}$, $G_{max} = 1.926 \times V_{th}$. With $V_{th} = 1.4$ V, an amplitude of 4.651 V for the row signal $V_s$ and 1.348 V for the column signal $V_d$ is found when driving one row at a time. (If Alt&Pleshko's formulas were used for N=64 rows, the same values would be found for $V_s$ and $V_d$ as in example 1.) If 4 rows are driven every time with orthogonal signals, then the amplitude of the row voltage F becomes 2.326 V and the maximum amplitude of the column voltage $G_{max}$ becomes 2.697 V so that a power supply voltage of 2×2.697=5.393 V is sufficient for the drive IC! Also in this example, it holds that $m = m_{eff}$. Since $p \neq p_{opt}$, a number ≠ 1 is found for $F/G_{max}$, namely 0.862.

EXAMPLE 3

The same display with N=64 rows and a liquid crystal with m=121 is now driven in such a way as if the maximum multiplexibility is 100, i.e. $m_{eff} = 100$, which means that the characteristic is slightly further driven than exactly between $V_{th}$ and $V_{sat}$. Thus, in this example, $N < m_{eff} < m$. Now we find: $V_s = 3.771 \times V_{th}$, $V_d = 0.943 \times V_{th}$, $p_{opt} = 4$, $F_{opt} = G_{max,opt} = 1.886 \times V_{th}$. With $V_{th} = 1.4$ V we find an amplitude of 5.280 V for the row signal $V_s$ when driving one row at a time and 1.320 V for the column signal $V_d$. (If Alt&Pleshko's for mulas were used for N=64 rows, the same values as in example 1 would be found again for $V_s$ and $V_d$.) If 4 rows are driven every time with orthogonal signals, then the amplitude of the row voltage F becomes 2.640 V and the maximum amplitude of the column voltage $G_{max}$ also becomes 2.640 V so that a power supply voltage of 5.280 V for the drive IC is sufficient. $F/G_{max}$ is 1 again.

EXAMPLE 4

A display with N=64 rows and a liquid crystal with m=256 yields the following values:

$$V_s=2.138\times V_{th},\ V_d=0.998\times V_{th},\ p_{opt}=2.14,\ F_{opt}=G_{max,opt}=1.461\times V_{th}.$$

Since p must be an integer, preferably a power of 2 ($p=2^S$), p is chosen to be 2 which leads to $F=1.512\times V_{th}$, $G_{max}=1.411\times V_{th}$. With $V_{th}=1.4$ V, we find an amplitude of 2.994 V for the row signal $V_s$ when driving one row at a time and 1.397 V for the column signal $V_d$. (If Alt&Pleshko's formulas were used for N=64 rows, the same values as in example 1 would be found again for $V_s$ and $V_d$.) If 2 rows are driven every time with orthogonal signals, then the amplitude of the row voltage F becomes 2.117 V and the maximum amplitude of the column voltage $G_{max}$ becomes 1.975 V so that a power supply voltage of 2×2.117=4.234 V is sufficient for the drive IC!

EXAMPLE 5

For a display with N=100 rows, in which a liquid crystal is used which is 100 times multiplexible (m=100), in which case Alt&Pleshko's maximum is found, it holds that:

$$V_s=7.454\times V_{th},\ V_d=0.745\times V_{th},\ p_{opt}=10,\ F_{opt}=G_{max,opt}=2.357\times V_{th}.$$

Since p must be an integer, preferably a power of 2 ($p=2^s$), p is chosen to be 8 so that $F=2.635\times V_{th}$, $G_{max}=2.108\times V_{th}$. With $V_{th}=1.4$ V, an amplitude of 10.435 V for the row signal $V_s$ and 1.044 V for the column signal $V_d$ is found when driving one row at a time. If 8 rows are driven every time with orthogonal signals, then the amplitude of the row voltage F becomes 3.689 V and the maximum amplitude of the column voltage $G_{max}$ becomes 2.951 V so that a power supply voltage of 2×3.7 V=7.4 V is sufficient for the drive IC! The mutual ratio $F/G_{max}$ is 1.250 in this case.

EXAMPLE 6

The same display with N=100 rows now has a liquid crystal with m=121. Then the formulas based on the invention yield:

$$V_s=5.665\times V_{th},\ V_d=0.883\times V_{th},\ p_{opt}=6.42,\ F_{opt}=G_{max,opt}=2.236\times V_{th}.$$

Since p must be an integer, preferably a power of 2 ($p=2^s$), p is chosen to be 8 so that $F=2.003\times V_{th}$, $G_{max}=2.497\times V_{th}$. With $V_{th}=1.4$ V, an amplitude of 7.93 V for the row signal $V_s$ and 1.236 V for the column signal $V_d$ is found when driving one row at a time. (If Alt&Pleshko's formulas were used for N=100 rows, the same values would be found four $V_s$ and $V_d$ as in example 5.) If 8 rows are driven every time with orthogonal signals, then the amplitude of the row voltage F becomes 2.804 V and the maximum amplitude of the column voltage $G_{max}$ becomes 3.495 V so that a power supply voltage of 2×3.495=6.990 V is sufficient for the drive IC! The ratio $F/G_{max}$ is now 0.802, while $m=m_{eff}$.

In the examples above, a choice has always been made for $P_{opt}=\sqrt{m}-\sqrt{m}-N$. If $p_{opt}=\sqrt{m}+\sqrt{m}-N$ is chosen, (which is introduced into the formula as from formula (15), then it follows for a display (example 7) with N=64 and $m_{eff}=100$ that:

$$V_s=7.542\times V_{th},\ V_d=0.471\times V_{th},\ P_{opt}=16 \text{ and } F_{opt}=G_{optmax}=1.886\times V_{th}.$$

The voltages $F,G_{max}$ found are identical to those of example 3. However, the number of rows to be driven simultaneously is larger, which requires a more complicated electronic circuit for driving the rows.

In summary, the invention relates to a passive-matrix liquid-crystal display driven by means of "multiple-row addressing", in which a group of rows is every time driven by mutually orthogonal signals, while the drive voltages are decreased by an optimum choice of the liquid crystal and the number of orthogonal signals.

What is claimed is:

1. A display device comprising:

a liquid crystal material between a first substrate that is provided with row electrodes and a second substrate that is provided with column electrodes, in which overlapping parts of the row and column electrodes define pixels, the liquid crystal material having a multiplexibility factor of m, that defines that maximum number of rows that can be driven with a maximum contrast, a column driver that is configured to apply voltages to the column electrodes corresponding to an image to be displayed, and a row driver that is configured to sequentially apply mutually orthogonal signals simultaneously to each subset of a plurality of subsets of the row electrodes, the row electrodes comprising N electrodes, N being not greater than the multiplexibility factor m, and each subset of the row electrodes substantially comprising p electrodes;

wherein the number, p, of row electrodes comprising each subset substantially corresponds to one of: $\sqrt{m_{eff}}+\sqrt{m_{eff}-N}$ and $\sqrt{m_{eff}}-\sqrt{m_{eff}-N}$, where meff is at least as great as N, and not greater than m.

2. A display device as claimed in claim 1, characterized in that the liquid crystal material is characterized by an optimal amplitude of column and row signals when driving N rows with one row at a time to achieve maximum contrast, and a maximum amplitude of the voltages that are applied to the column electrodes and a maximum amplitude of the mutually orthogonal signals that are applied to each subset of row electrodes is smaller than half a sum of the optimal amplitudes of column and row signals when driving N rows with one row at a time.

3. A display device as claimed in claim 1, characterized in that the liquid crystal material is characterized by an amplitude of column and row signals required when driving N rows with one row at a time to achieve discernible contrast between pixel ON and OFF states, and a maximum amplitude of the voltages that are applied to the column electrodes and a maximum amplitude of the mutually orthogonal signals that are applied to each subset of row electrodes is smaller than a minimum of half a sum of the amplitudes of column and row signals required for selecting one row at a time.

4. A display device as claimed in claim 1, characterized in that, for a ratio of amplitudes F of the mutually orthogonal voltages that are applied to each subset of row electrodes and amplitude $G_{max}$ of a maximum voltage that is applied to the column electrodes, $0.7<F/G_{max}<1.3$.

5. A display device as claimed in claim 1, characterized in that $N<m$.

6. A display device as claimed in claim 1, characterized in that $m_{eff}$ is substantially equal to the multiplicity parameter.

7. A display device as claimed in claim 1, characterized in that the number of row electrodes in each subset is a power of two, or one less than a power of two.

8. A display device as claimed in claim 1, characterized in that the row driver and the column driver comprise at least one integrated circuit device for applying both row signals and column voltages.

* * * * *